US005423390A

United States Patent [19]

Donnally et al.

[11] Patent Number: 5,423,390

[45] Date of Patent: Jun. 13, 1995

[54] PIPE RACKER ASSEMBLY

[75] Inventors: Robert B. Donnally; Baldwin Zahn, both of Houston, Tex.

[73] Assignee: Dreco, Inc., Houston, Tex.

[21] Appl. No.: 135,171

[22] Filed: Oct. 12, 1993

[51] Int. Cl.[6] ..... E21B 19/15

[52] U.S. Cl. ..... 175/85; 166/77.5; 166/85; 414/22.55

[58] Field of Search ..... 175/52, 85; 414/22.55, 414/22.58, 22.66, 22.62, 22.54; 166/77.5, 85

[56] References Cited

U.S. PATENT DOCUMENTS

| | | | |
|---|---|---|---|
| 3,312,294 | 4/1967 | Wilson | 173/164 |
| 3,506,075 | 4/1970 | Atteb | 175/52 |
| 3,978,993 | 9/1976 | Howard | 175/85 X |
| 3,994,350 | 11/1976 | Smith et al. | 175/85 |
| 4,077,525 | 3/1978 | Callegari et al. | 175/85 X |
| 4,547,109 | 10/1985 | Young et al. | 175/85 X |
| 4,718,805 | 1/1988 | Becker | 175/85 X |
| 4,834,604 | 5/1989 | Brittain et al. | 175/85 X |
| 4,951,759 | 8/2990 | Richardson | 175/85 |
| 5,018,588 | 5/1991 | Haberer | 175/85 X |
| 5,049,020 | 9/1991 | McArthur | 175/85 X |

*Primary Examiner*—Ramon S. Britts
*Assistant Examiner*—Frank S. Tsay
*Attorney, Agent, or Firm*—Lalos & Keegan

[57] ABSTRACT

The pipe racker assembly includes a mast, a dolly assembly vertically slidably secured to the mast for vertical movement, a handling arms assembly rotatably secured to the dolly assembly and having an upper handling arm extensible to accommodate pipes of varying length and as long as 45 feet and lower arms capable of gripping pipe either from a horizontal pipe rack or from a carousel pipe rack turntable when the handling arms are rotated 90° on the dolly assembly. A stabilizer is secured to the ends of the handling arms in order to allow the handling arms assembly to be supported remote from the pipe racker assembly to reduce the structural strength requirements of the assembly.

40 Claims, 4 Drawing Sheets

PIPE RACKER ASSEMBLY

BACKGROUND OF THE INVENTION

Rigs used for drilling wells such as oil and gas wells may be used either in a marine environment or on land where they are transportable by customized trailers. When rigs are in position adjacent an oil well, pipe rackers are utilized to move pipe from a pipe storage environment, typically a horizontal pipe rack or a carrousel pipe rack turntable to a position over the well where by conventional means it is directed down the well hole. The procedure is reversed when removing any pipe from the well.

THE PRIOR ART

The Richardson U.S. Pat. No. 4,951,759 discloses a loading arm that pivots, rotates and extends to manipulate the position of a length of pipe. The patent also includes means to rotate the loading arm about an axis parallel to the mast to transpose the pipe from outside the mast to inside and also provide a hydraulic cylinder that vertically adjusts the position of the loading arms to raise or lower the pipe from or to the drill string. However the patent does not disclose a dolly with attached pipe manipulation system that can ride up and down the mast and rotate about an axis transverse to the mast to accommodate pipe in both horizontal pipe racks and vertically stored pipes in a carrousel rack turntable. There is no rotation of the handling arm to align it properly with a carrousel pipe rack or a horizontal rack nor any grip extension cylinder that permits the grip mechanisms to be extended and reach pipes at a distance from the mast nor an upper handling arm telescoping cylinder permitting the handling of stands of different lengths of pipe nor any upper and lower stabilizing pivot points for precise positioning to the well center.

The Young et al U.S. Pat. No. 4,547,109 discloses a pipe handling system especially suited to a slant-type drilling rig. In this system the drilling rig frame is displaceable from horizontal to a more vertical position.

Callegari et al U.S. Pat. No. 4,077,525 discloses a pipe handling apparatus particularly adapted to handle the storage and removal of pipes from a finger board. The pipe handling arm is extensible and may extend or retract to move pipe between the well head and the pipe rack. The gripping hand may rotate at the end of the arm to position the pipe at the end of the grooves in the finger board. Also the gripping hand is fixed to an extensible arm that is rotatable about the fixed manipulating arm to permit the pipe handling apparatus to place or retrieve a pipe from the furthermost positions in the finger board.

Howard U.S. Pat. No. 3,978,993 discloses a pipe racking mechanism suited to a well drilling rig with a vertical support structure and a pipe rack in the support structure. The pipe rack includes a finger board and a lower rack member. Upper racker and lower racker means are provided to move pipe between the pipe rack and the center of the support structure. Racker grabbing heads are carried in tubular guides to permit movement into and out of the mast finger board. This patent, however, does not disclose means for moving the pipe from vertical and horizontal racks and provides no rotating dolly structure nor any disclosure of means for the vertical displacement of the entire pipe handling apparatus to accommodate varying sized pipes.

The patent to Attebo U.S. Pat. No. 3,506,075 discloses a pipe gripping arm system adapted to move pipe from a magazine on the inside of the mast to an outer position coaxial with the drill string. The pipe dripping system includes an inner arm connected for rotational movement relative to the mast and an outer arm connected for rotational movement relative to the inner arm.

Wilson U.S. Pat. No. 3,312,294 discloses a pipe handling device for picking up a length of pipe from or adding to the pipe in the well. There is no apparatus disclosed wherein a vertically traveling dolly is provided.

SUMMARY OF THE INVENTION

The present invention provides a pipe racker assembly that includes a) a platform and mast assembly, b) a dolly assembly, c) a handling arms assembly, and d) stabilizers in order to allow the movement to and grasping of pipe from either a horizontal pipe rack or from a carrousel pipe rack turntable. The pipe racker assembly of the present invention also is designed to be constructed of lighter structural materials through the use of stabilizers that support the handling arms assembly when in a 90° rotated position at the time it is grasping or holding pipe in a vertical position for movement to or from a well hole.

The pipe racker assembly includes a platform and mast assembly that accommodates a dolly assembly for vertical slidable movement along one side of the mast and on the face of the legs of the mast. Rails positioned on the mast cooperate with a skate structure on the dolly assembly to allow the dolly using the skate to slide by means of sliding wear pads, along the track formed by the rails. The dolly can be raised vertically along the mast to the extent required to raise the pipe from a horizontal position or from a vertical position up to the well hole.

The handling arms assembly having pivotally connected booms with an upper handling arm and a pair of transversely positioned lower handling arms is capable of accommodating various lengths of pipe by extending the upper handling arm to control the space between the lower handling arms. The entire handling arms assembly is rotatably positioned on and moves vertically with the dolly assembly by being secured to a turret that rotates about a shaft fixed to the dolly assembly.

The handling arms assembly also provides for both the pivotal movement of and the extension of the lower handling arms and accompanying grips in order to grasp and hold the pipe during its movement to or from the well hole.

The stabilizers are positioned on the handling arms assembly and allow the weight of the handling arms assembly to rest upon a support external of the mast and the pipe handling apparatus but supported on the platform. This external support capability relieves the weight from the booms and turret and therefore allows lighter weight structural material to be used in the construction of the pipe racker assembly.

OBJECTS OF THE INVENTION

It is the object of the present invention to provide a pipe racker assembly that is capable of versatile movement for grasping of a pipe regardless of the common types of storage facility for the pipe.

A further object of the present invention is the provision of a dolly assembly that allows the entire pipe handling apparatus to be both raised and lowered vertically along the mast in order to accommodate the positioning of the pipe as well as rotated 90° if desired.

A further object of the present invention is the provision of a handling arms assembly that permits the accommodation of varying sizes of pipe and permits the accommodation of the handling of pipe from either a horizontal pipe rack or carrousel rack turntable by grips at the end of extensible lower handling arms.

A further object of the present invention is the provision of stabilizers that permit the support of the weight of the handling arms assembly at a point spaced from the pipe handling apparatus so as to minimize the structural weight of the entire assembly to permit easy transportation.

THE DRAWINGS

DESCRIPTION OF THE PREFERRED EMBODIMENT

The Pipe Racker Assembly in General

The preferred pipe racker assembly shown generally at 10 throughout the drawings, is essentially composed of four principal elements. The platform and mast assembly A, the dolly assembly B, the handling arms assembly C and the stabilizers D.

Platform And Mast Assembly

Figure 1:
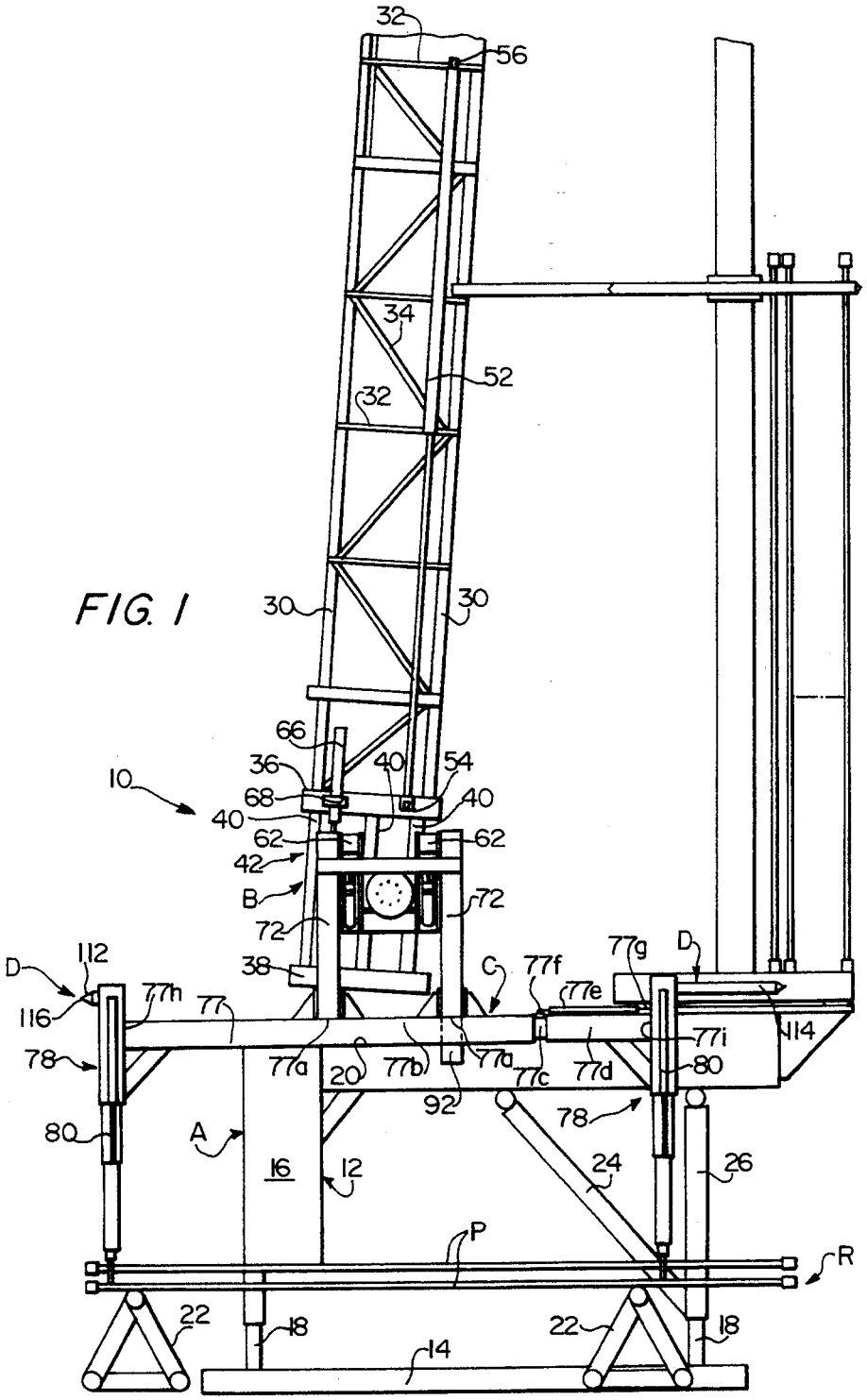
FIG. 1 is a side elevational view, partly broken away, of the pipe racking assembly of the present invention, including the mast and the adjustable supporting platform for the mast, as well as the lower handling arms shown in a vertically downward position to handle pipes in a horizontal pipe rack.
Figure 2:
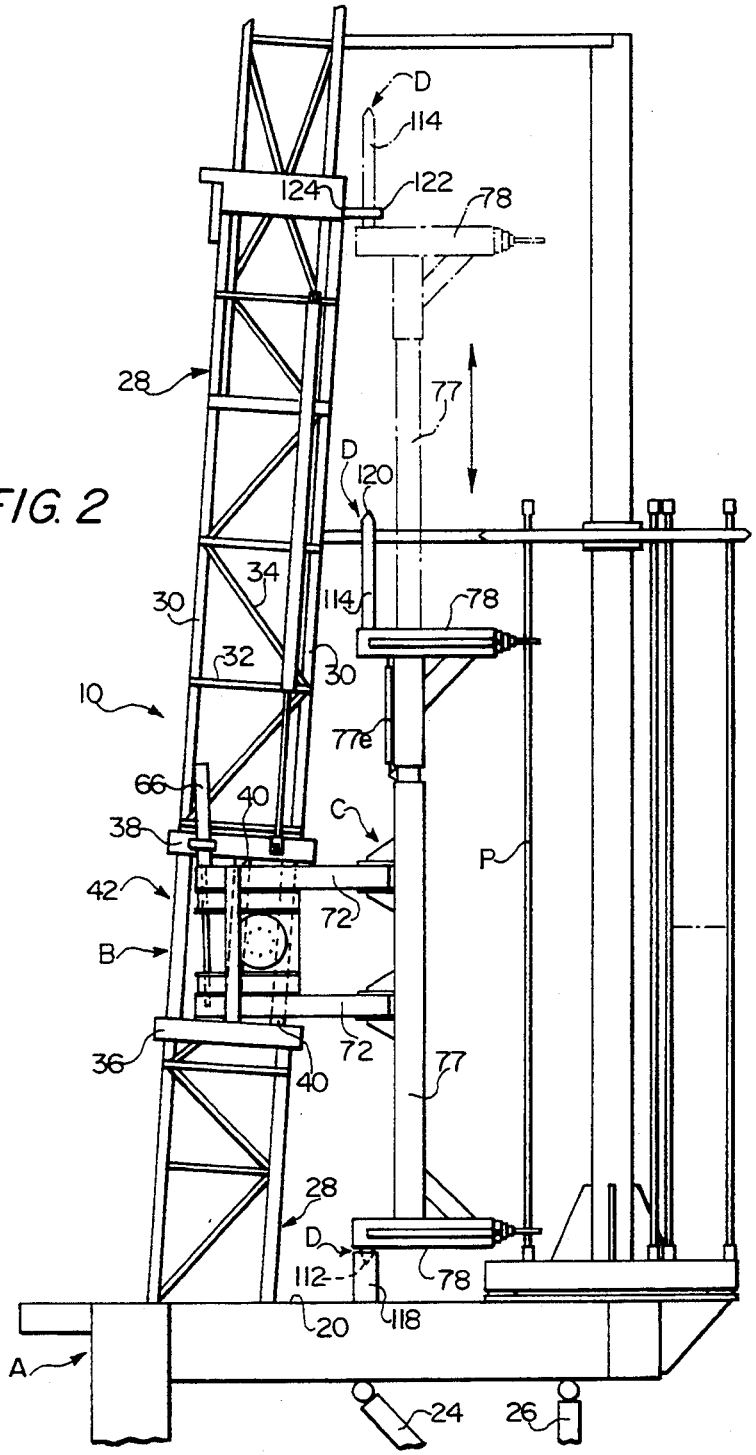
FIG. 2 is a side elevational view, partly broken away, and partially in phantom lines, illustrating the extensible upper handling arm to accommodate varying sizes of pipe and the handling arm assembly in a 90° rotated position to contact pipes in a vertical pipe rack or a carrousel rack turntable.

As best shown in FIGS. 1 and 2 of the drawings, the platform and mast assembly A is composed of an extensible platform assembly 12 that may be transportable, if desired, on a conventional trailer, not shown or used in a marine environment if desired. The following description is limited to use for a gas or oil well on land.

The platform assembly 12 is conventional, having a base 14, on which is positioned vertical support 16 having extensible arms 18 to raise and lower the extensible platform assembly 12 and the horizontal platform 20. A horizontal pipe rack R is supported at its ends by supports 22,22, as illustrated in FIGS. 1 and 4, to hold a plurality of pipes P.

Suitable arms 24, 26 are used to provide the extensibility of the platform 20 as it is raised or lowered from the base 14. Secured to the platform 20 is the mast 28 that may be tiltable in any conventional manner by means not shown. The mast 28 may be a conventional mast, having suitable drawworks, also not shown. The mast may be composed of a plurality of sections that may be raised and lowered vertically over the platform 20 as desired. The mast is positioned adjacent the well hole, best shown at W in FIGS. 5 and 6.

Figures 3, 4, 7, 8:
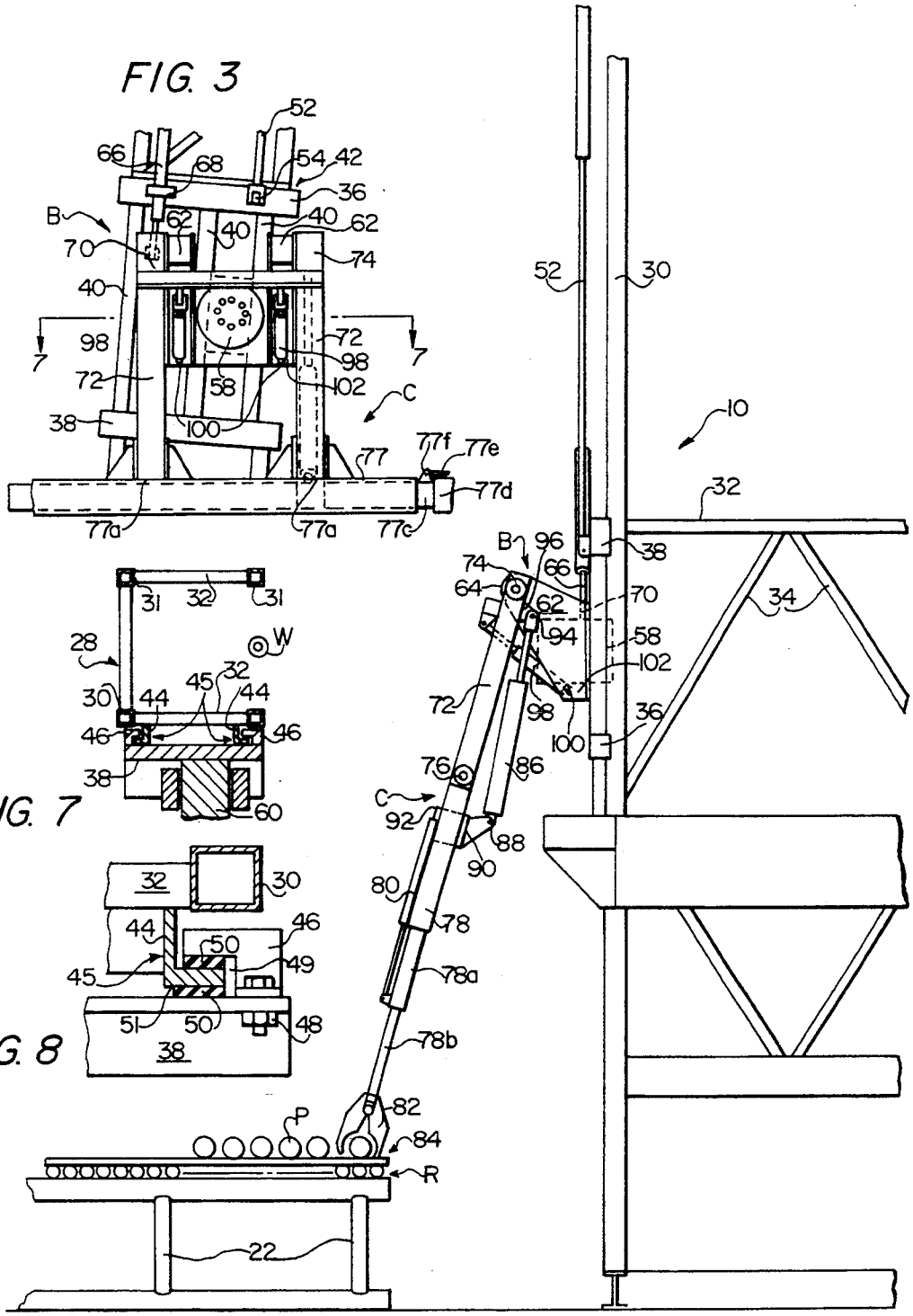
FIG. 3 is a side elevational view, partly broken away, of the dolly assembly vertically movable along the mast.
FIG. 4 is a side elevational view, partly broken away, of the mast, the dolly assembly, the handling arms and the grip mechanism for grasping pipes from the horizontal pipe rack shown.
FIG. 7 is a cross sectional view, partly broken away, illustrating the U-shape of the mast positioned around the well center and the sliding skate of the dolly assembly.
FIG. 8 is an enlarged view of the lower right side of the view of FIG. 7 that illustrates the frictionless sliding wear pads allowing the dolly assembly to slide vertically along the mast.

The mast 28 has a U-shaped cross section as best shown in FIG. 7 and is composed of two pairs of uprights or legs, a front pair 30, 30 and a rear pair 31,31 that may be hollow as shown in FIG. 8. Horizontal cross members 32 and diagonal cross members 34 secure the legs together to form the mast 28 in the conventional manner.

The Dolly Assembly

One of the unique features of the present invention is the dolly assembly B illustrated in each of the drawing FIGS. 1–8. The dolly assembly B is composed of a pair of horizontal bars 36 and 38 spaced apart and secured together by a plurality of verticals 40 that together form a steel frame constituting a rigid dolly 42. The dolly assembly B is designed to function in a manner that enables the dolly assembly to slide vertically along one side or face of the mast 28 adjacent legs 30, 30.

Figure 5:
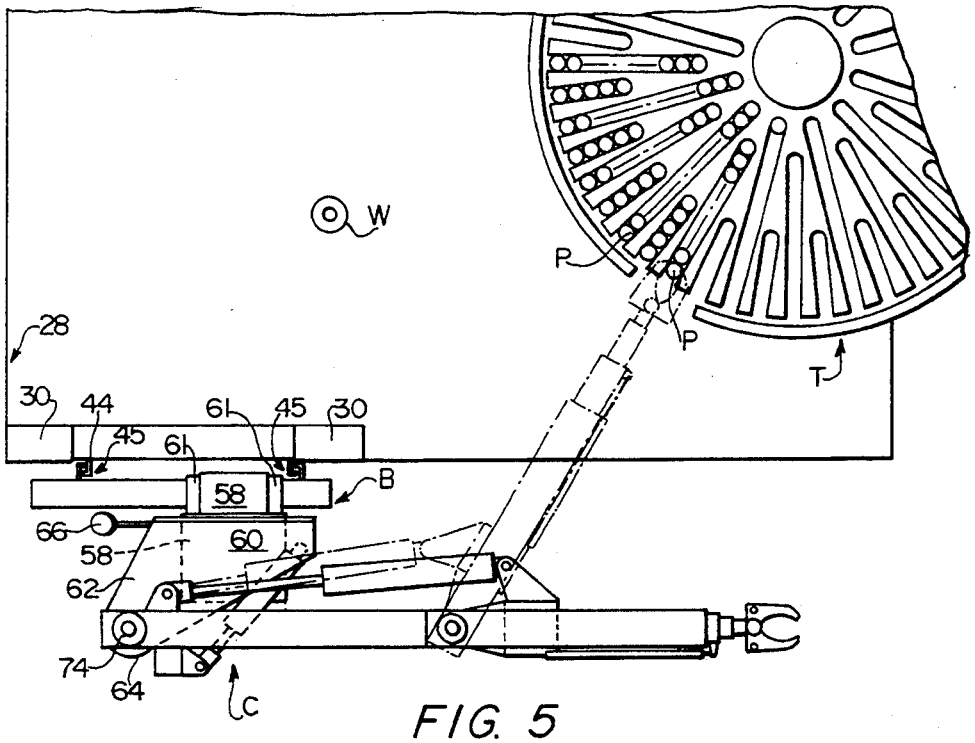
FIG. 5 is a plan view, partly broken away, of the pipe handling apparatus of the present invention, including in phantom lines, the multiple movement capabilities of the handling arm and its movement towards the carrousel rack turntable shown.
Figure 6:
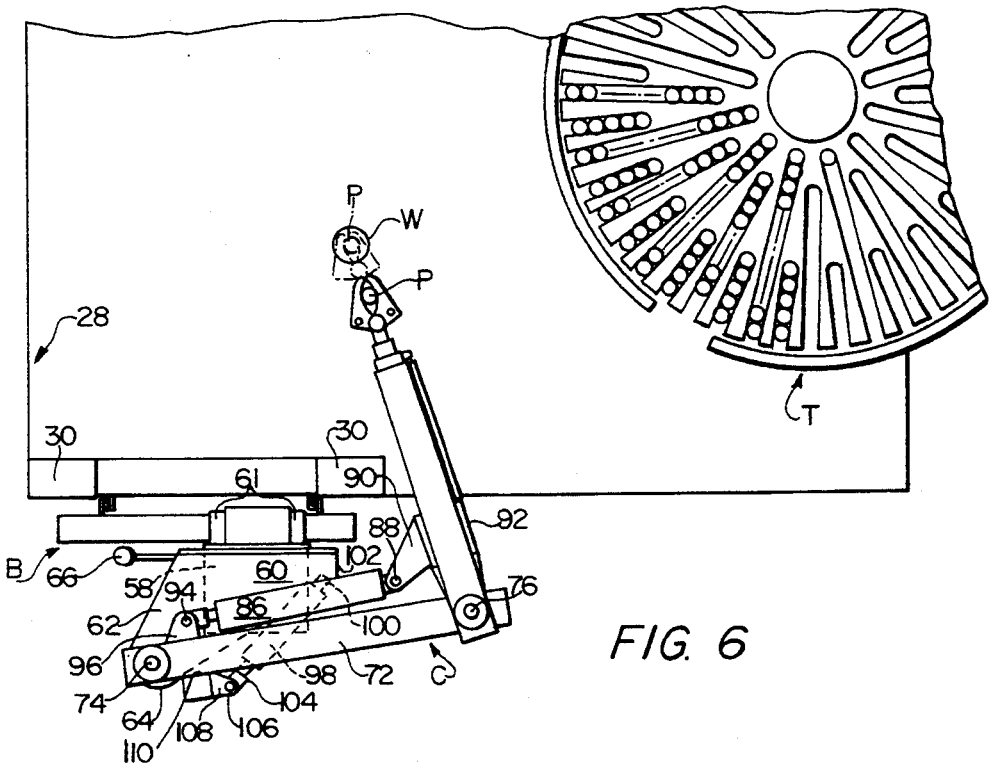
FIG. 6 is a view similar to that of FIG. 5 showing the handling arm having gripped a pipe from the carrousel rack turntable and moving it towards the well center shown.

The unique sliding capability of the dolly assembly B is achieved by reason of a pair of opposed angles or rails 44,44 forming a track 45 best shown in FIGS. 7 and 8, but also seen in FIGS. 5 and 6. For convenience, the rails 44 are not shown in FIGS. 1 through 4 in order not to obscure other structure. Sliding along the mast within the track 45 formed by rails 44 is a skate structure 46, 46 formed by elongated angle-irons cooperatively opposed to the rails 44. The skate 46 is secured suitably, as by screw fasteners 48, to the horizontal bars 36,38 of the dolly 42. As best shown in FIG. 8, the skate 46 and the horizontal bars 36, 38 are spaced from each other as shown at 49 by means of sliding wear pads 50,50 on each side of legs 51 of each of the rails 44,44. These sliding wear pads can be made of any frictionless material such as nylon, Teflon or the like, it being only important that the opposed metal surfaces of the angles and skate are kept from wear producing sliding contact.

The dolly assembly B is moved along the mast 28 through the cooperation of the skate 46 and rails 44 by a skate cylinder 52, best shown in FIGS. 1, 2 and 4, that is secured at one end 54 to the horizontal bar 36 and at the other end 56 to a remote horizontal cross member 32 forming part of the mast 28. The skate cylinder is preferably a hydraulic ram though it may be any air cylinder that will essentially accomplish the same control of the vertical movement of the dolly assembly 42. It is also possible that conventional draw works could be used to raise and lower the dolly along the mast 28.

Transversely secured between at least a pair of verticals 40 is a rigid shaft 58 of substantial diameter, at least 2 and up to 5 feet or greater being preferred, onto which is rotatably secured a turret 60 with suitable internal rotary bearings 61. The turret possesses a through bore to accommodate the horizontal shaft 58 and, as is best shown in FIGS. 3, 5 and 6, is provided with a pair of elongated ears 62,62 that extend in spaced parallel planes outwardly from on each side and substantially parallel to the axis of the turret 60. Each ear 62 also extends axially forwardly beyond the circumference of the turret 60 as shown at 64.

The turret is rotated by means of rotation cylinder 66, extending substantially parallel to the long axis of the mast and positioned on the outside of the mast. The rotation cylinder 66 is suitably secured to the horizontal bar 36 at one intermediate portion of its extent, shown at 68 and, at the other, to a portion of the ear 62, as shown at 70, all as best depicted in FIGS. 3 and 4 of the drawings. The rotation cylinder 66 is similar to the skate cylinder 52 in that it may be a hydraulic cylinder or air cylinder but its operation is such as to provide the torque to rotate the dolly assembly B about the axis of shaft 58 through extending and retracting the rotation cylinder. The end 70 of the rotation cylinder 66 is pivotally secured to the ear 62 from which it follows that as the rotation cylinder 66 extends, the body of the cylinder 66 may move within the secure bounds at 68 as required by the pivotal connection between the end 70 of the rotational cylinder and the ear 62.

Handling Arms Assembly

The handling arms assembly C is best shown in FIGS. 1, 2, 4, 5 and 6 and is designed to operate from and move with the dolly assembly B vertically as the dolly assembly moves along the mast and rotatably as the turret 60 rotates within the dolly assembly about the shaft 58. The handling arms assembly is capable of moving toward and away from the well W, as shown in FIGS. 5 and 6, toward and away from the horizontal pipe rack R, as shown in FIG. 4, toward and away from the carrousel pipe rack turntable T, as shown in FIGS. 1, 5 and 6 or any other movement toward and away from the well W that is typically within or closely adjacent to the mast 28.

In order to accomplish the variety of movements necessary to not only grasp pipe P from the horizontal pipe rack R, the pipe racker of the present invention is also capable of choosing and grasping a pipe P from the vertical carrousel rack turntable T. To achieve these movements, a sophisticated arrangement is secured to the turret 60.

As best shown, particularly in FIGS. 1–4, a pair of spaced booms 72,72 extend outwardly from the turret 60 and to one side of the remaining portion of the mast, as best shown in FIG. 4. These are the main booms that pivot the entire handling arms assembly about the turret 60. At one end, the booms 72,72 are secured by a pivotal arrangement at axis 74 to their respective ears 62,62 and at the other end, the main boom is pivotally connected to an upper handling arm 77.

The upper handling arm 77 is pivotally connected at *77a* to the ends of the main booms 72,72. The tubular structure of the upper handling arm allows an important function to take place. As shown in FIGS. 1 and 3, the upper handling arm is extensible, which is desirable to accommodate varying sizes of pipe P. The elongated outer tubular *77b* forms the stationary portion of the extensible upper handling arm 77. Positioned within the elongated outer tubular *77b* is a second or inner tubular *77c* that is stationary axially relative to the concentric elongated outer tubular *77b*. Telescopically movable along the inner tubular *77c* is extendible tubular *77d* that preferably has the same inner and outer diameter as the elongated tubular *77b*. Upper handling arm telescoping cylinder *77e* is secured at one end *77f* to the inner tubular and at the other end *77g* to the end of the extendable tubular *77d* remote from the elongated tubular *77b* for extending the upper handling arm 77 and thus the pipe handling capability for accommodating various lengths of pipe P. The extend of this movement capability is best shown by the phantom lines of FIG. 2. Pipes P or other tubulars from 30 feet to 45 feet or greater may be properly grasped, supported and controlled for movement from or to either the horizontal pipe rack R of FIGS. 1 and 2 or the carousel rack turntable T of FIGS. 5 and 6.

The ends *77h*, *77i* of the elongated tubular *77b* and extendable tubular *77d* are connected to the lower handling arms 78,78. These handling arms, as shown best in FIG. 4, are extensible telescopically into several sections *78a*, *78b*, etc. by reason of grip extension cylinders 80,80 attached to each of the lower handling arms 78,78. As best shown in FIG. 4 also, the grip extension cylinder is secured at one end to the lower handling arm 78 and at the other, to one or the other of the telescopically arranged lower handling arms *78a*, *78b*, etc. At the end of each of the lowermost extensible lower handling arms *78b*, is a jaw 82 forming a grip 84 for grasping the pipe. The action of the jaws is conventional and can be opened and closed by any suitable mechanism to grip the pipe P.

In order to articulate the lower handling arms 78,78 about the main booms 72,72 a swing arm cylinder 86 is utilized to pivot the lower handling arm 78 about the articulated joints *77a*,*77a*. The swing arm cylinder is pivotally secured at one end 88 to an ear 90, secured to a collar 92, shown in FIG. 4, that surrounds the lower handling arm 78. At the other end of the swing arm cylinder, a pivotal connection is made at 94 with an eye 96 secured to the upper end of the main boom 72, as best shown in FIGS. 5 and 6.

Main boom cylinders 98,98 are secured pivotally at 100 to ears 102,102 secured to the turret 60 opposite to the positioning of ears 62,62. The piston ends 104,104 of the main boom cylinders are pivotally secured at 106,106 to ears 108,108 that protrude from the surfaces 110,110 of the main booms 72,72.

The Stabilizers

Secured to each of the lower handling arms 78,78 remote from their working ends are stabilizing means 112 and 114 that protrude outwardly from each of the lower handling arms 78,78 in a direction parallel to and away from the upper handling arm 77. The stabilizer 112 is the primary and most useful of the stabilizers and as will be noted from FIG. 1 primarily is in the form of a short bar or rod having a pointed end 116. The operating end 116 of stabilizer 112 is designed to be received within complementary support 118 that is secured in any conventional manner to platform 20. At the opposite end of the upper handling arm 77 and positioned on the other lower handling arm 78 is stabilizer 114 that as shown in FIGS. 1 and 2 is also pointed at 120 but is much longer as it extends parallel to the axis of the upper handling arm 77.

At the upper end of the mast 28, the suitable support 122 is shown to protrude horizontally from the mast 28 at 124. The support 122 includes an opening not shown to receive the elongated stabilizer 114 as shown in the phantom line extension of the upper handling arm 77 in FIG. 2.

The stabilizers 112 and 114 act separately and independently to stabilize and control the movement of the handling arm assembly C when rotated in a 90° arc from that shown in FIG. 1 to the position shown in FIG. 2. Each of the stabilizers 112 and 114 acts differently and is not required to be active together or at any one time.

As particularly shown in FIG. 2 the action of stabilizer 112 in combination with its contact into support 118 allows the handling arms assembly C to grasp pipe P while a substantial portion of the weight, that would otherwise be supported at the turret 60 and the shaft 58 is now supported as shown in FIG. 2 at support 118. Thus the significant weight of pipe P that otherwise would have been producing a very substantial torque onto the turret 60 and the shaft 58 is now supported by the support 118. Thus the movements of the lower handling arms 77,77 can be performed to grasp and move the pipe P from a vertical position in the carousel turntable T as shown in FIG. 5 to the well hole W as shown in FIG. 6. The particular advantage of utilizing the support 118 is that with the diminished torque directed to the handling arms assembly C the weight of the supporting elements forming the turret 60, the boom 72,72 and all other elements may be reduced substantially. The lower strength requirements for such elements make the entire rig more easily transportable and more economical to construct.

The operation of the stabilizer 114 and its cooperation with the support 122 is simply to control and limit any swinging movement that may occur upon the substantial extension of upper handling arm 77 as may occur should it be necessary for the handling arms assembly to accommodate a substantially longer pipe length than those shown schematically in FIGS. 1 and 2. In such an event in order to prevent any swinging movement, the stabilizer 114 as it enters the opening in support 122 controls the sidewise movement of the handling arm 78 removed from the support 118.

In operation the piperacker assembly of the present invention is capable of handling a variety of pipe lengths from 30 feet to 45 feet or greater as well as any other tubular that may be appropriately used for oil well operations. The design of the pipe racker assembly enables it to operate from a horizontal pipe rack R as shown in FIG. 1 or from the carrousel rack turntable T as shown in FIGS. 2, 5 and 6.

Whether the pipe racker assembly is picking up the pipe P from the rack R or from the carrousel rack turntable T, the dolly assembly B is appropriately positioned on mast 28 by the skate cylinder 52. In the instance shown in FIG. 1 the skate cylinder is extended to bring the dolly assembly to its low point on the mast 28 wherein the rotation cylinder 66 acts on the turret to rotate the dolly assembly about the shaft 58 to directly confront the pipe P on the pipe rack R.

If the pipe P is of random lengths the distance between the lower arms 78, 78 may be adjusted by operating upper handling arm telescopic cylinder **77*e* changing the spacing between upper handling arm 77 and lower handling arm 78 allowing the proper positioning of the pipe P in the arm for proper egress to and from well center W. When the proper spacing of the lower handling arms has been reached in accordance with the length of pipe P and the angle of the lower handling arms 78, 78 with respect to the main boom 72 by the operation of swing arm cylinder 86, then lower handling arms 78, 78 may be extended by reason of grip extension cylinders 80 so that telescopic members 78*a* and 78*b* may be extended toward the pipes P wherein gripping jaws 82 may be operated to grasp pipe P. In the position shown in FIG. 1 with pipe P grasped but still horizontal, pipe P is lifted from the rack R by retracting grip extension cylinders 80 and skate cylinder 52 while rotating turret 60 about shaft 58 by operating rotation cylinder 66 so that the entire handling arms assembly C is rotated 90 degrees to a position substantially as shown in FIG. 2. When in the 90 degree rotated position of FIG. 2, the handling arms assembly C has a grasp of pipe P that is now in the vertical position similar to the position that the pipe would be in if extracted from the carrousel pipe rack turntable T of FIG. 2**.

As soon as the rotation of the dolly assembly has been complete through the operation of rotation cylinder 66, the upper boom arm 72 is located over the stabilizer support 118 by operation of cylinders 98 and stabilizer 112 and 114 may be inserted into their supports 118 and 120. In the position as shown in FIG. 2, the pipe P is vertical and well in the grasp of the handling arms assembly through jaws 82 of grip 84, then there only remains for the pipe to be transported while in the vertical position toward the center of the mast 28 where the well W is positioned. To achieve such a position, swing arm cylinder 86 is contracted to pivot the lower handling arms 78, 78 about the upper boom arm 72 to move the lower handling arms 78, 78 from a position external of the mast 28 to a position substantially nestled within the mast and directly over the well hole W.

Another feature of this pipe racker assembly is to be able to trip doubles by manually changing the distance between upper arms 78, 78 by telescopic cylinder piece **77*e***. This feature will also allow the handling of doubles from rack R.

We claim:

1. A pipe racker apparatus for handling pipe comprising, a mast, a dolly assembly slidably secured to said mast for vertical movement thereon, dolly assembly positioning means operatively connected to said apparatus for moving said dolly assembly along said mast, a handling arms assembly rotatably secured on said dolly assembly for movement with said dolly assembly and a plurality of handling arms included in said handling arms assembly, said handling arms having pipe grasping means secured to said arms.

2. The pipe racker of claim 1 wherein said handling arms assembly includes boom means and a turret rotatably secured on said dolly assembly.

3. The pipe racker of claim 2 wherein said boom means is pivotally secured to said turret.

4. The pipe racker of claim 3 including, boom rotating means positioned between said dolly assembly and said turret for rotating said boom means and said handling arms about a substantially horizontal axis.

5. The pipe racker of claim 2, said handling arms including an upper handling arm extending transversely to said boom means and a pair of lower handling arms extending transversely to said upper handling arm.

6. The pipe racker of claim 1 including, a plurality of extending means for extending said handling arms.

7. The pipe racker of claim 5, said pipe grasping means including grip means secured to said lower handling arms.

8. The pipe racker of claim 5 including, said upper handling arm having telescopically positioned extensible members, one of said extensible members being extensible outwardly to accommodate varying sizes of pipe.

9. The pipe racker of claim 8, said extending means including an upper handling arm-extending means secured between said extensible members.

10. The pipe racker of claim 1, said handling arms being pivotally secured on said apparatus for movement toward and away from said dolly assembly.

11. The pipe racker of claim 5, swing arm means secured between said boom means and said handling arms for pivoting said lower handling arms about said upper handling arm.

12. The pipe racker of claim 1 including, stabilizing means secured on said apparatus spaced from said mast for supporting said handling arms external to said apparatus.

13. The pipe racker of claim 12, said stabilizing means including a rod for contact with a support remote from said apparatus whereby to enable said handling arms to move toward and away from said mast and a pipe rack.

14. The pipe racker of claim 1 including, boom means carried by said handling arms assembly, a turret rotatably secured on said dolly assembly, said boom means is pivotally secured to said turret, boom rotating means positioned between said dolly assembly and said turret for rotating said boom means and said handling arms about a substantially horizontal axis, and said handling arms including an upper handling arm extending transversely to said boom means and a pair of lower handling arms extending transversely to said upper handling arm.

15. The pipe racker of claim 1 including boom means carried by said handling arms assembly, a turret rotatably secured on said dolly assembly, said boom means is pivotally secured to said turret, said handling arms including an upper handling arm extending transversely to said boom means and a pair of lower handling arms extending transversely to said upper handling arm, and a plurality of extending means for extending said handling arms in mutually transverse directions.

16. The pipe racker of claim 1 wherein boom means carried by said handling arms assembly, a turret rotatably secured on said dolly assembly, said boom means is pivotally secured to said turrets.

said handling arms including an upper handling arm extending transversely to said boom means and a pair of lower handling arms extending transversely to said upper handling arm, a plurality of extending means for extending said handling arms in mutually transverse directions, and said upper handling arm having telescopically positioned extensible members, one of said extensible members being extensible outwardly from said boom means to accommodate varying sizes of pipe.

17. The pipe racker of claim 1, said handling arms including upper and lower handling arms being pivotally secured for movement toward and away from said dolly assembly and including swing arm means for pivoting said lower handling arms about said upper handling arm, and stabilizing means secured on said apparatus spaced from said mast for supporting said handling arms.

18. The pipe racker of claim 1, said handling arms including upper and lower handling arms being pivotally secured for movement toward and away from said dolly assembly and including swing arm means for pivoting said lower handling arms about said upper handling arm, stabilizing means secured on said apparatus spaced from said mast for supporting said handling arms, and said stabilizing means including a rod for contact with a support remote from said apparatus whereby to enable said handling arms to move toward and away from said mast and a pipe rack.

19. The pipe rack of claim 1 including, boom means carried by said handling arms assembly, a turret rotatably secured on said dolly assembly, said boom means is pivotally secured to said turret, said handling arms including an upper handling arm extending transversely to said boom means and a pair of lower handling arms extending transversely to said upper handling arm, said handling arms being pivotally secured to said boom means for movement toward and away from said dolly assembly, swing arm means secured between said boom means and said handling arms for pivoting said lower handling arms about said upper handling arm, stabilizing means secured on said apparatus spaced from said mast for supporting said handling arms, and said stabilizing means including a pivot for contact with a support remote from said apparatus whereby to enable said handling arms toward and away from said mast and a pipe rack.

20. The pipe rack of claim 1 including boom means carried by said handling arms assembly, a turret rotatably secured on said dolly assembly, said boom means is pivotally secured to said turret, said handling arms including an upper handling arm extending transversely to said boom means and a pair of lower handling arms extending transversely to said upper handling arm, a plurality of extending means for extending said handling arms in mutually transverse directions, said upper handling arm having telescopically positioned extensible members, one of said extensible members being extensible outwardly from said boom means to accommodate varying sizes of pipe, said handling arms being pivotally secured to said boom means for movement toward and away from said dolly assembly, swing arm means secured between said boom means and said handling arms for pivoting said lower handling arms about said upper handling arm, stabilizing means secured on said apparatus spaced from said mast for supporting said handling arms, and said stabilizing means including a rod for contact with a support remote from said apparatus whereby to enable said handling arms to move toward and away from said mast and a pipe rack.

21. A pipe racker apparatus for handling pipe comprising, a mast, a handling arms assembly rotatably secured on said mast including a plurality of handling arms, said handling arms having pipe grasping means secured to said arms, stabilizing means secured on said apparatus spaced from said mast for supporting said handling arms, and said stabilizing means constructed for contacting with a support remote from said apparatus whereby to enable said handling arms to be supported at said support.

22. The pipe racker of claim 21 including, boom means supported by said handling arms assembly, and a turret rotatably secured on said mast.

23. The pipe racker of claim 22 wherein said boom means is pivotally secured to said turret.

24. The pipe racker of claim 23 including, boom rotating means positioned between said mast and said turret for rotating said boom means and said handling arms about a substantially horizontal axis.

25. The pipe racker of claim 22, said handling arms including an upper handling arm extending transversely to said boom means and a pair of lower handling arms extending transversely to said upper handling arm.

26. The pipe racker of claim 25 within, said upper handling arm having telescopically positioned extensible members, one of said extensible members being extensible outwardly from said boom means to accommodate varying sizes of pipe.

27. The pipe racker of claim 21 wherein, said handling arms assembly being pivotally secured for movement toward and away from said mast and including upper and lower handling arms.

28. The pipe racker of claim 27 including, boom means and swing arm means forming part of said handling arms assembly, said swing arm means being secured between said boom means and said handling arms for pivoting said lower handling arms about said upper handling arm.

29. The pipe racker of claim 21 including, boom means carried by said handling arms assembly, a turret rotatably secured on said mast, said boom means is pivotally secured to said turret, boom rotating means positioned between said mast and said turret for rotating said boom means and said handling arms about a substantially horizontal axis, and said handling arms including an upper handling arm extending transversely to said boom means and a pair of lower handling arms extending transversely to said upper handling arm.

30. The pipe racker of claim 21 including, boom means carried by said handling arms assembly, a turret rotatably secured on said mast, said boom means is pivotally secured to said turret, said handling arms including an upper handling arm extending transversely to said boom means and a pair of lower handling arms extending transversely to said upper handling arm, and a plurality of extending means for extending said handling arms in mutually transverse directions.

31. The pipe racker of claim 21 including, boom means carried by said handling arms assembly, and a turret rotatably secured on said mast, said boom means is pivotally secured to said turret, said handling arms including an upper handling arm extending transversely to said boom means and a pair of lower handling arms extending transversely to said upper handling arm, a plurality of extending means for extending said handling arms in mutually transverse directions, and said upper handling arm having telescopically positioned extensible members, one of said extensible members being extensible outwardly from said boom means to accommodate varying sizes of pipe.

32. The pipe racker of claim 21 including, said handling arms assembly being pivotally secured for movement toward and away from said mast and including upper and lower handling arms, boom means and swing arm means forming part of said handling arms assembly, said swing arm means being secured between said boom means and said handling arms for pivoting said lower handling arms about said upper handling arm.

33. A pipe racker apparatus for handling pipe comprising, a mast, a handling arms assembly rotatably secured on said mast and including a plurality of handling arms, said handling arms having pipe grasping means secured to said arms, one of said handling arms having telescopically positioned extensible members and being extensible along a horizontal or a vertical axis whereby to accommodate varying sizes of pipe.

34. The pipe racker of claim 33 including a turret rotatably secured on said mast.

35. The pipe racker of claim 34 wherein said handling arms are pivotally secured to said turret.

36. The pipe racker of claim 35 including, handling arms rotating means positioned between said mast and said turret for rotating said turret and said handling arms about a substantially horizontal axis.

37. The pipe racker of claim 33 including, said handling arms including an upper handling arm extending transversely and a pair of lower handling arms extending transversely to said upper handling arm.

38. The pipe racker of claim 31 including, boom means, said handling arms being pivotally secured to said boom means for movement toward and away from said mast.

39. The pipe racker of claim 38 including, swing arm means secured between said boom means and said handling arms for pivoting said lower handling arms about said upper handling arm.

40. The pipe racker of claim 33 including, a turret rotatably secured on said mast, boom means pivotally secured to said turret, and boom rotating means positioned between said mast and said turret for rotating said boom means and said handling arms about a substantially horizontal axis.

* * * * *

UNITED STATES PATENT AND TRADEMARK OFFICE

CERTIFICATE OF CORRECTION

PATENT NO. : 5,423,390

DATED : June 13, 1995

INVENTOR(S) : Robert B. Donnally, Baldwin Zahn

It is certified that error appears in the above-identified patent and that said Letters Patent is hereby corrected as shown below:

Column 12:
In Claim 38, line 1, delete "31" and insert therefor -- 37 --.

Signed and Sealed this

Fourteenth Day of November, 1995

Bruce Lehman

*Attest:*

BRUCE LEHMAN

*Attesting Officer*

*Commissioner of Patents and Trademarks*